US007387052B2

(12) United States Patent
Chang et al.

(10) Patent No.: US 7,387,052 B2
(45) Date of Patent: Jun. 17, 2008

(54) WRENCH WITH OUTSTANDING GRIP

(76) Inventors: Chiou-Mai Chang, No. 37-2, Ching-Dau 1st Street, Taichung (TW) 404; Yueh-Li Wang, No. 37-2, Ching-Dau 1st Street, Taichung (TW) 404

( * ) Notice: Subject to any disclaimer, the term of this patent is extended or adjusted under 35 U.S.C. 154(b) by 0 days.

(21) Appl. No.: 11/432,202

(22) Filed: May 12, 2006

(65) Prior Publication Data

US 2007/0261520 A1 Nov. 15, 2007

(51) Int. Cl.
*B25B 23/16* (2006.01)

(52) U.S. Cl. ..... 81/177.1; 81/119; 81/125.1

(58) Field of Classification Search ..... 81/119, 81/125.1, 177.1
See application file for complete search history.

(56) References Cited

U.S. PATENT DOCUMENTS 4,947,713 A * 8/1990 Arnold ..... 81/121.1
4,969,231 A * 11/1990 Mader et al. ..... 16/421
5,079,978 A * 1/1992 Kupfer ..... 81/119
6,148,701 A * 11/2000 Lee ..... 81/489

* cited by examiner

*Primary Examiner*—Joseph J. Hail, III
*Assistant Examiner*—Shantese L McDonald
(74) *Attorney, Agent, or Firm*—WPAT, P.C.; Anthony King

(57) ABSTRACT

The present invention relates to a wrench of hand tool comprising a grip wherein at least one end of the grip is a driving head, and there is a sunken area on the surface of the grip. The sunken area is filled with many convexities and intensive knurl is implemented and embossed mark is established, the embossed mark being surrounded with the intensive knurl is visually outstanding so that the marks are outstanding of visual identification meanwhile the purpose of comfort and firmness in grip is achieved.

3 Claims, 13 Drawing Sheets

WRENCH WITH OUTSTANDING GRIP

FIELD OF THE INVENTION

The present invention relates to a wrench of hand tool wherein the grip has a sunken area which is filled with many convexities and convex marks so that the marks are outstanding of visual identification meanwhile the purpose of comfort and firmness in grip is achieved.

BACKGROUND OF THE INVENTION

A conventional wrench is shown on FIG. 18. Normally, a conventional wrench would have been processed with either reflexible or non-reflexible surface treatment; which means the body 20, grip 21, mark area 22, mark 221 and all other areas are either reflexible or non-reflexible. Defects of a conventional wrench are described as follows:

1. Since the surface treatment is applied to the whole set of the wrench, the mark 221 and the body 20 are in the same condition; besides, the mark area 22 is not wide enough to have bigger mark 221, therefore the mark 221 is not easy to be identified with the body 20. When an operator is working at a dim place such as inside an engine compartment of an automobile, varieties of wrenches are not easy to be identified and then operations are bothered.

2. Since the whole set of the wrench has either reflexible surface or non-reflexible surface except the two driving ends, surface of the wrench is in a flat and smooth condition without substance to create enough friction to avoid getting loose in hand when operating.

3. In manufacturing process of the wrench, the mark area 22 and the mark 221 are generally forged to form with use of jigs. After certain numbers of the forging process, the jigs are likely damaged of abrasion with the body 20, cracks are easily coming out on the edge of the mark area 22 and in between the mark area 22 and the mark 221, and then productions are fault.

The present invention is an improvement on the shortcomings of the conventional wrench described above.

SUMMARY OF THE INVENTION

The present invention relates to structural improvement of a wrench which includes a body with its grip in appropriate length, a sunken area in appropriate shape and depth for mark on one side of the grip, intensive plurality of knurls and embossed mark inside the sunken area; the surface of the embossed mark are not the same as that of the knurl in the sunken area, but the same as that of the grip, therefore the mark is outstanding of visual identification.

DETAILED DESCRIPTION OF THE PREFERRED EMBODIMENT

Figure 2:
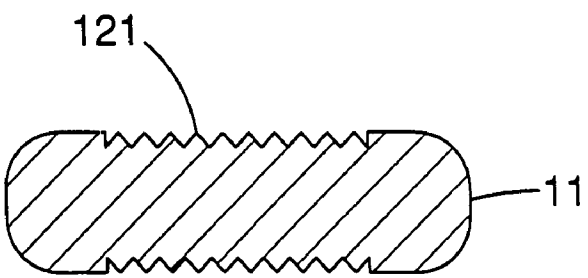
FIG. 2 is a cross-section view of the first embodiment of the invention.
Figure 1:
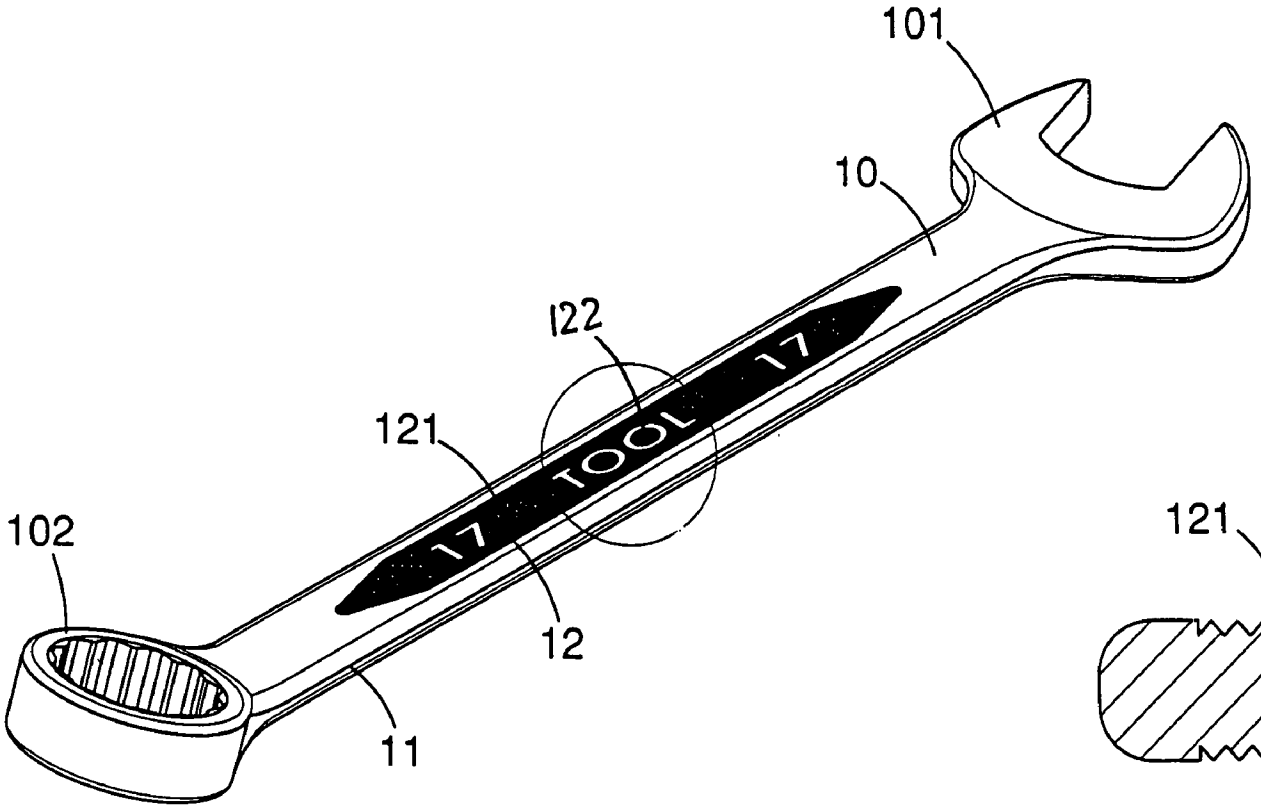
FIG. 1 is a 3-dimensional diagram of the first embodiment of the invention.

Referring to FIGS. 1 and 2, the wrench 10 of the present invention comprises a grip 11 which has two ends and a longitudinal axis connecting with two ends, and at least one end is a driving head, this embodiment shows the grip has two driving heads on both ends, one is an open end driving head 101 and the other is a box end driving head 102; the grip has two flat surfaces and there is at least one mark area in appropriate width and length on the surface of the grip 11, the mark area includes a sunken area 12 with appropriate depth wherein intensive plurality of knurls 121 is implemented therein and at lease one embossed mark 122 is established therein, the embossed mark 122 being surrounded with the intensive plurality of knurls 121 is visually outstanding. The embodiment shows the top of the plurality of knurls 121 and the surface of the grip 11 are in same level, the embossed mark 122 inside of the sunken area 12 can be letter, symbol or graph, the top of the embossed mark 122 and the surface of the grip 11 can be in same level.

Figure 3:
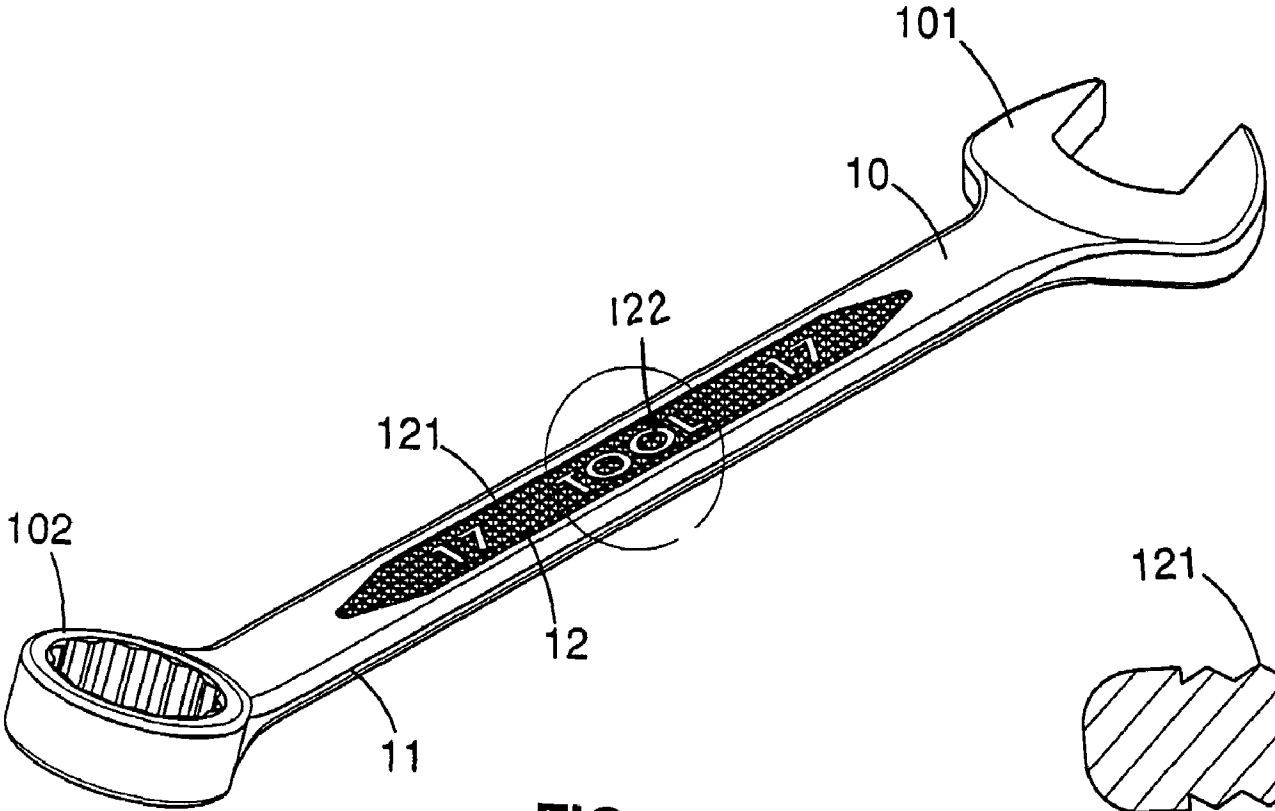
FIG. 3 is a 3-dimensional diagram of the second embodiment of the invention.
Figure 4:
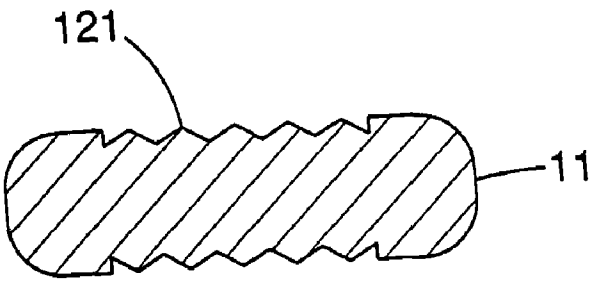
FIG. 4 is a cross-section view of the second embodiment of the invention.

Referring to FIGS. 3 and 4, the second embodiment of the present invention shows larger scale of knurl 121 inside of the sunken area 12 by using press forming such that more friction would be created when gripping.

Figure 5:
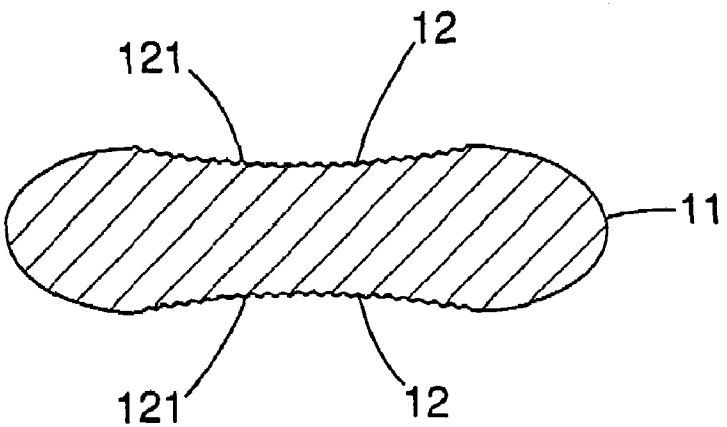
FIG. 5 is a cross-section view of the third embodiment of the invention.

Referring to FIG. 5, the third embodiment of the present invention shows that the cross section of the grip 11 is shaped oval, on which the sunken area 12 is a concaved curve and the knurl 121 is in smaller scale.

Figure 6:
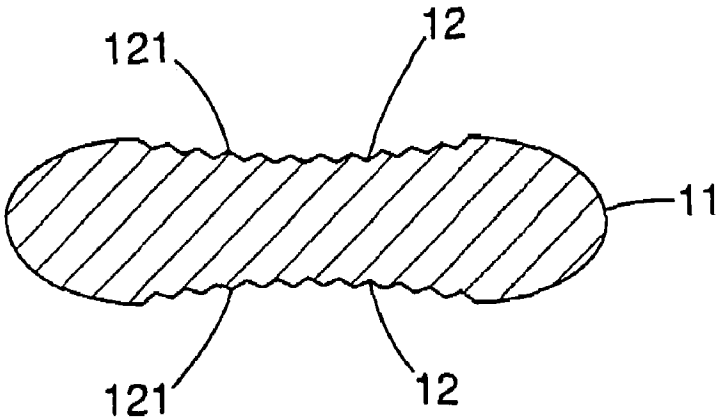
FIG. 6 is a cross-section view of the fourth embodiment of the invention.

Referring to FIG. 6, the fourth embodiment of the present invention shows that the cross section of the grip 11 is shaped oval, on which the sunken area 12 is a concaved curve and the knurl 121 is in larger scale.

Figure 7:
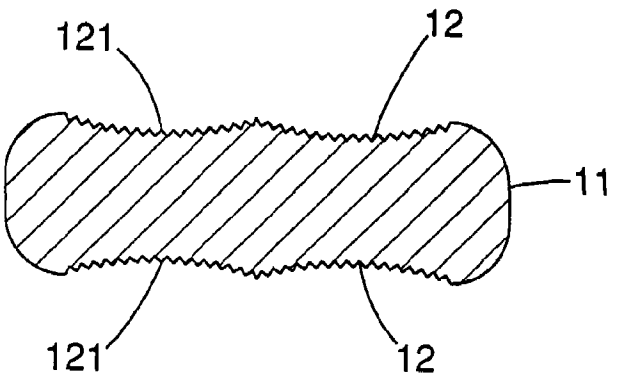
FIG. 7 is a cross-section view of the fifth embodiment of the invention.

Referring to FIG. 7, the fifth embodiment of the present invention shows that the cross section of the bottom of the sunken area 12 is a conjunction of several concaved curves.

Figure 8:
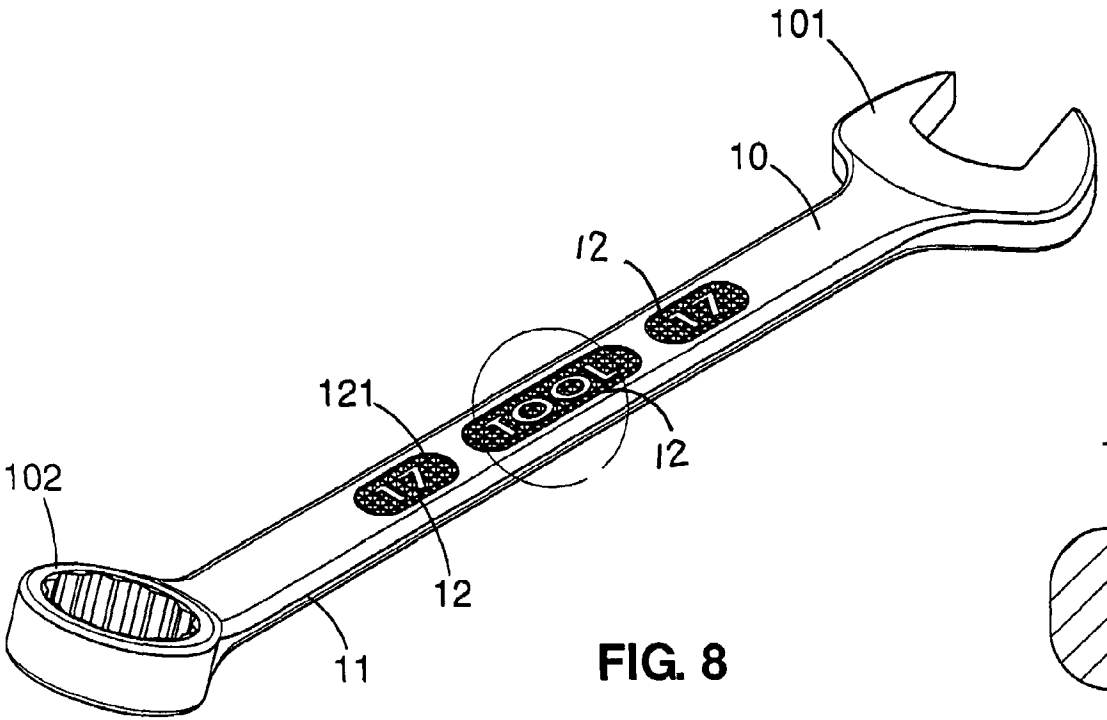
FIG. 8 is 3-dimensional diagram of the sixth embodiment of the invention.

Referring to FIG. 8, the sixth embodiment of the present invention shows that there are three mark areas, i.e. three sunken areas 12 on the grip 11.

Figure 9:
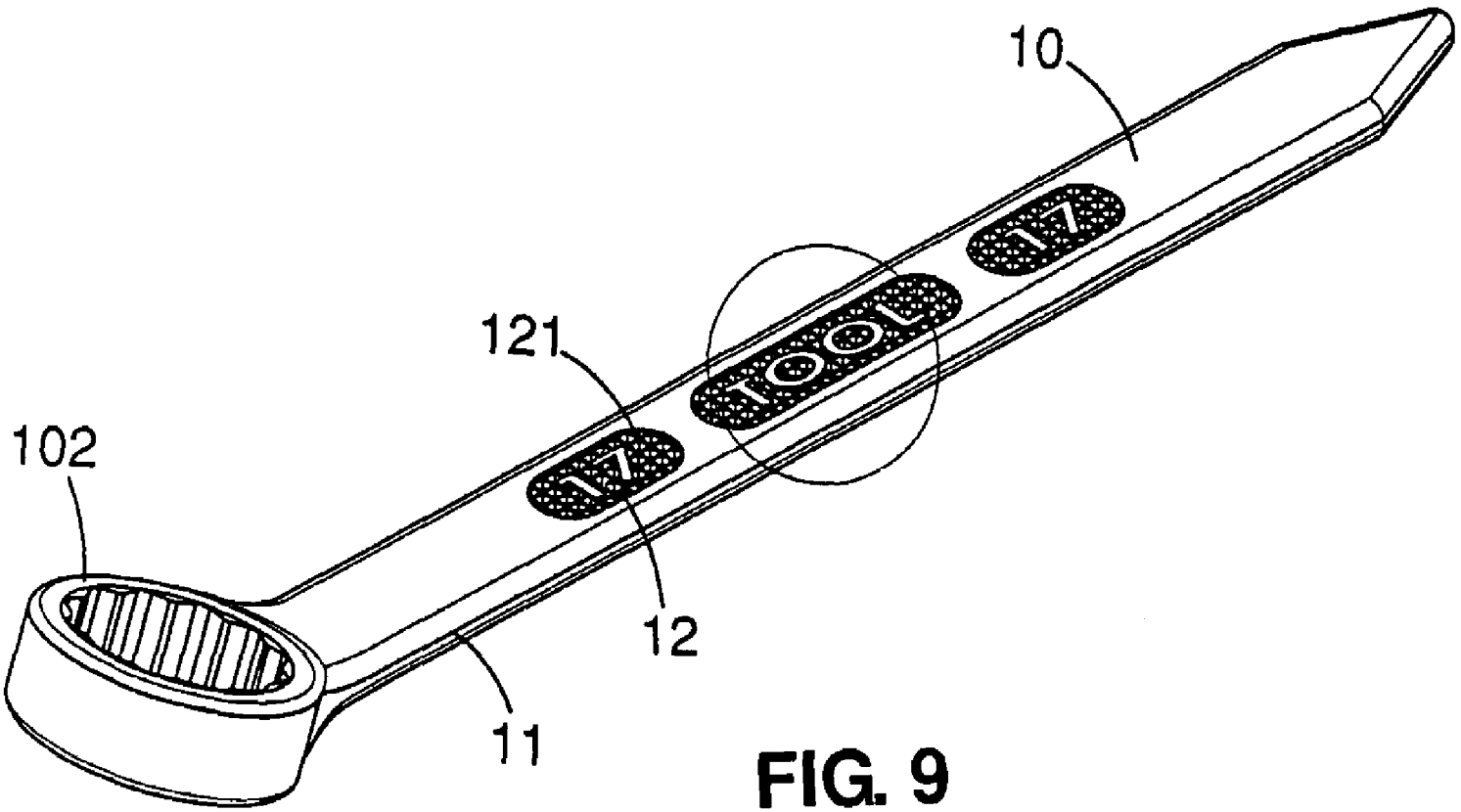
FIG. 9 is a 3-dimensional diagram of the seventh embodiment of the invention.

Referring to FIG. 9, the seventh embodiment of the present invention shows that the grip 11 has a driving head 102 at one end.

Figure 10:
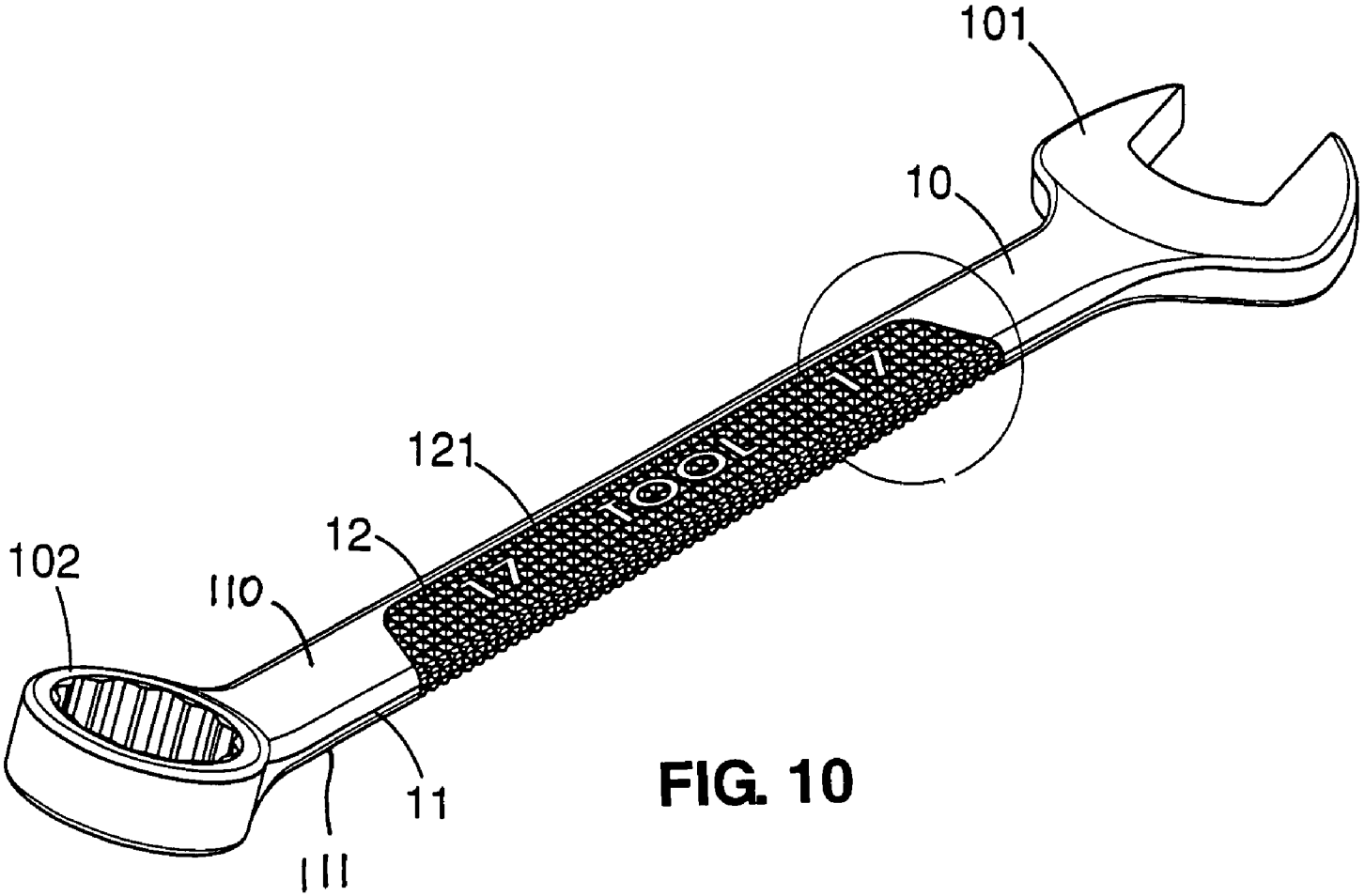
FIG. 10 is a 3-dimensional diagram of the eighth embodiment of the invention.

Referring to FIG. 10, the eighth embodiment of the present invention shows that the grip 11 is flat and wide with two flat grip surfaces 110 and 111, and the mark area extends onto one side of the grip surface 110/111.

Figure 11:
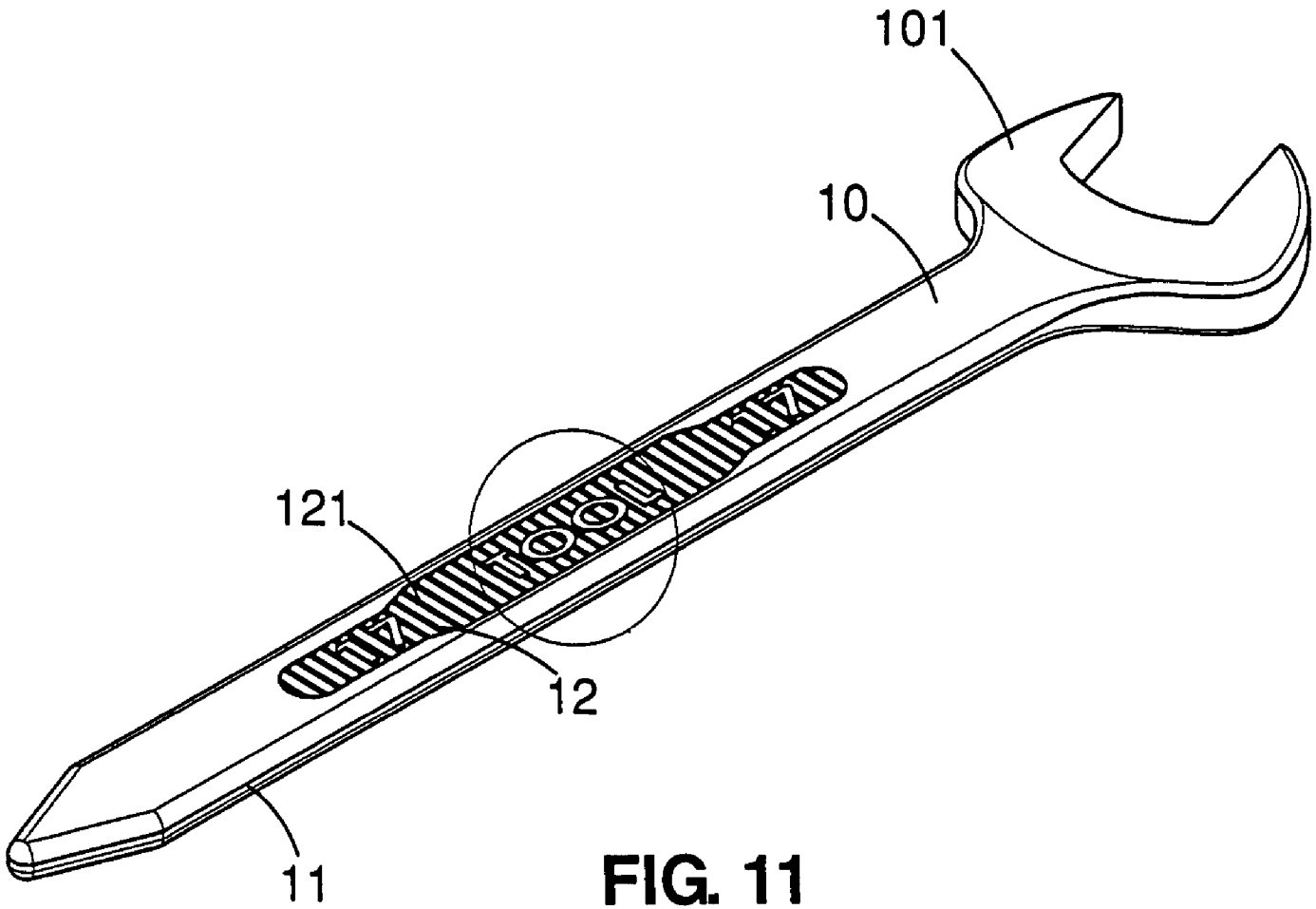
FIG. 11 is a 3-dimensional diagram of the ninth embodiment of the invention.

Referring to FIG. 11, the ninth embodiment of the present invention shows that each of the plurality of knurls 121 inside of the sunken area 12 is in striped shape that is vertical to the extending direction of the longitudinal axis of the wrench.

Figure 13:
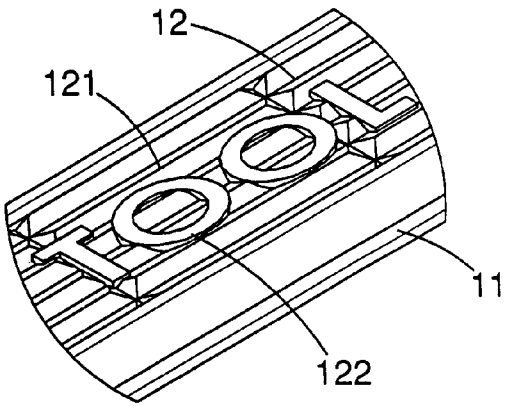
FIG. 13 is a partial enlarged diagram of the tenth embodiment of the invention.
Figure 12:
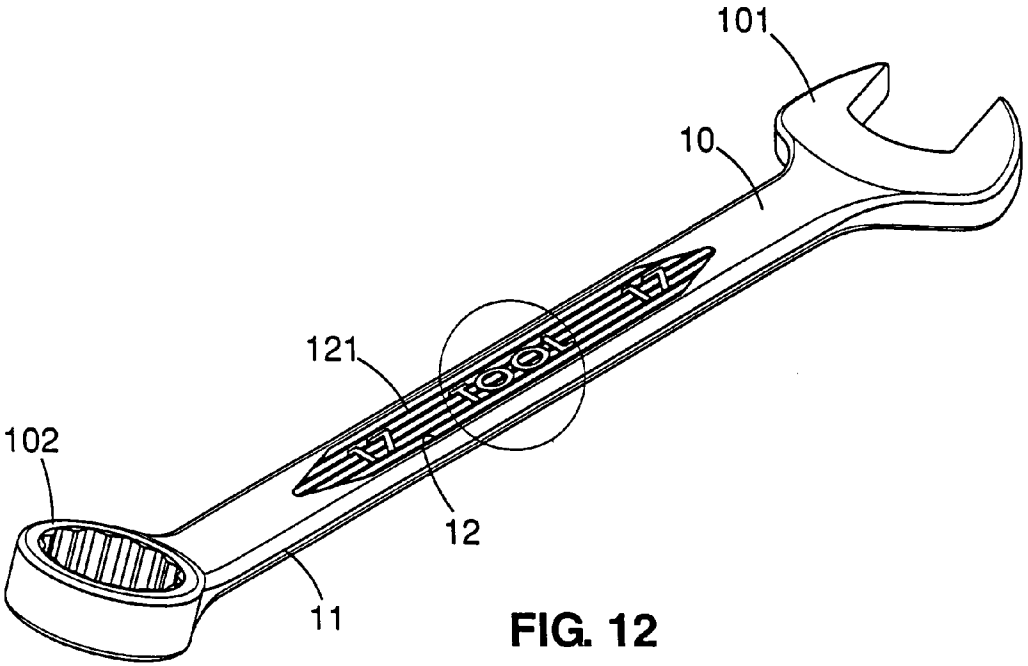
FIG. 12 is a 3-dimensional diagram of the tenth embodiment of the invention.

Referring to FIGS. 12 and 13, the tenth embodiment of the present invention shows that each of the plurality of knurls 121 inside of the sunken area 12 is in striped shape which extending direction is parallel to the direction of the longitudinal axis of the wrench.

Figure 14:
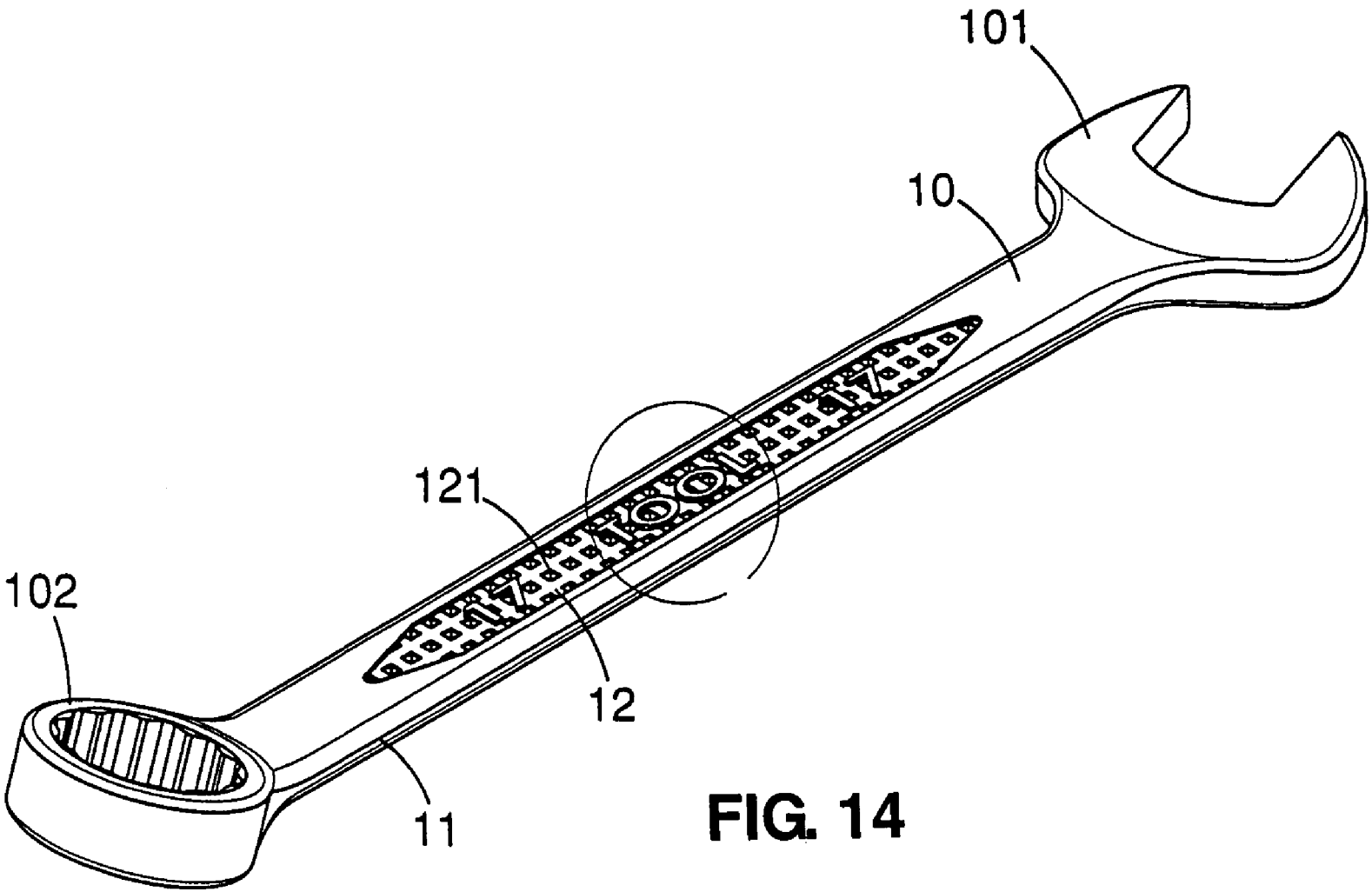
FIG. 14 is a 3-dimensional diagram of the eleventh embodiment of the invention.

Referring to FIG. 14, the eleventh embodiment of the present invention shows that the knurl 121 inside of the sunken area 12 has bigger spacing between each knurl.

Figure 15:
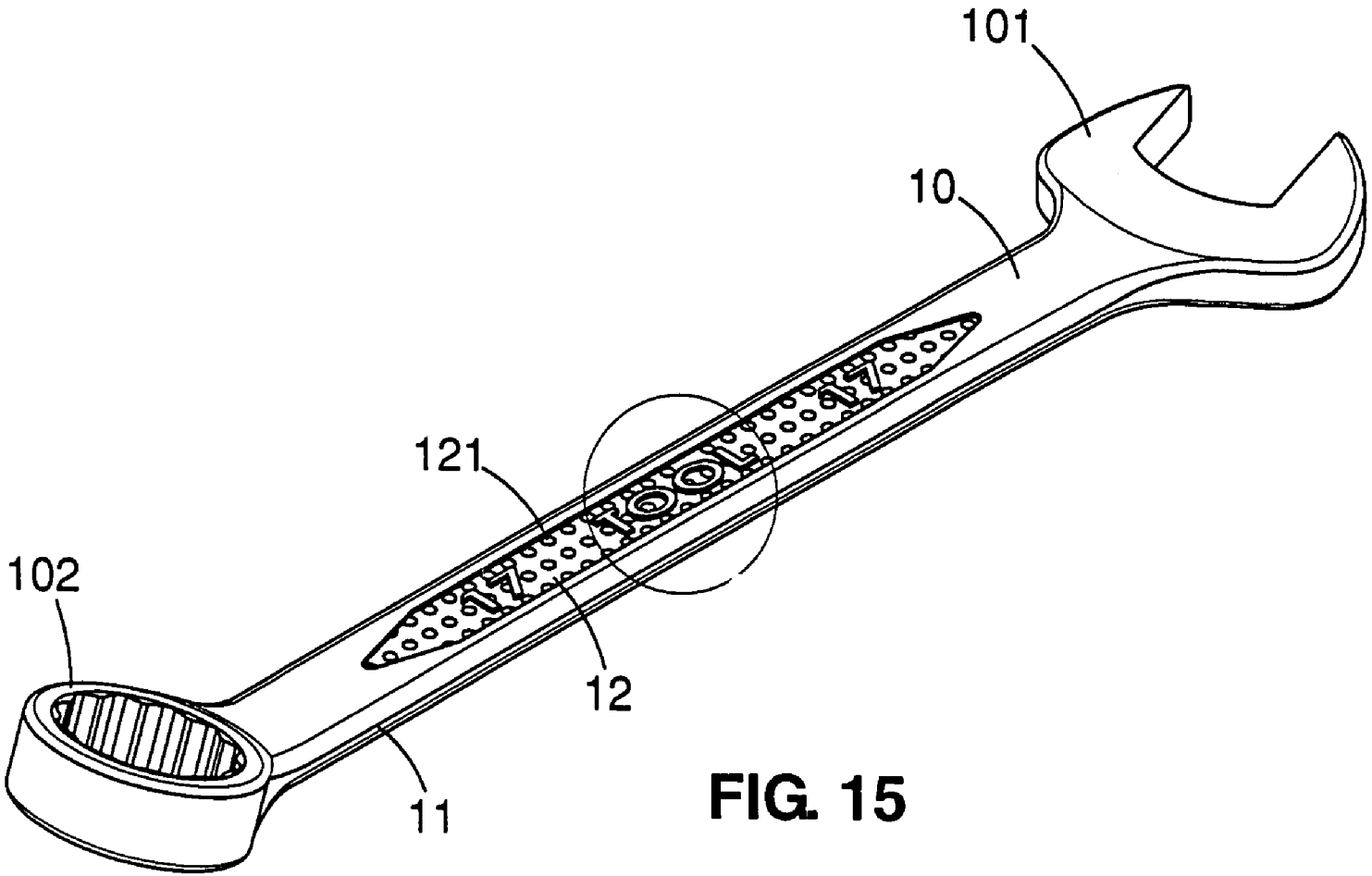
FIG. 15 is a 3-dimensional diagram of the twelfth embodiment of the invention.

Referring to FIG. 15, the twelfth embodiment of the present invention shows that the knurls 121 inside of the sunken area 12 are dot knurls.

Figure 16:
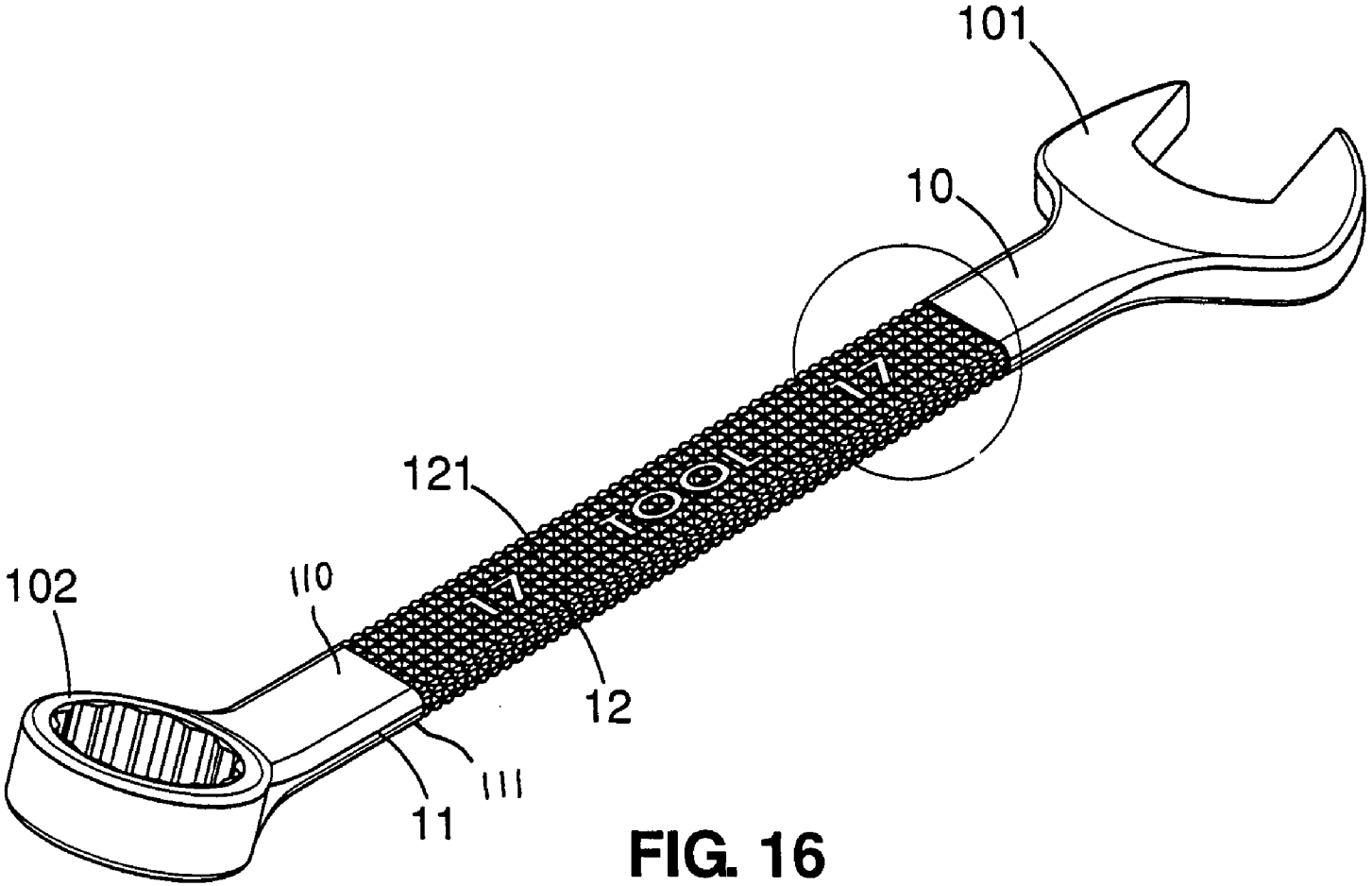
FIG. 16 is a 3-dimensional diagram of the thirteenth embodiment of the invention.

Referring to FIG. 16, the thirteen embodiment of the present invention shows that the grip 11 is flat and wide with two flat grip surfaces 110 and 111, and the sunken area 12 extends onto both sides of the grip surface 110/111.

Figure 17:
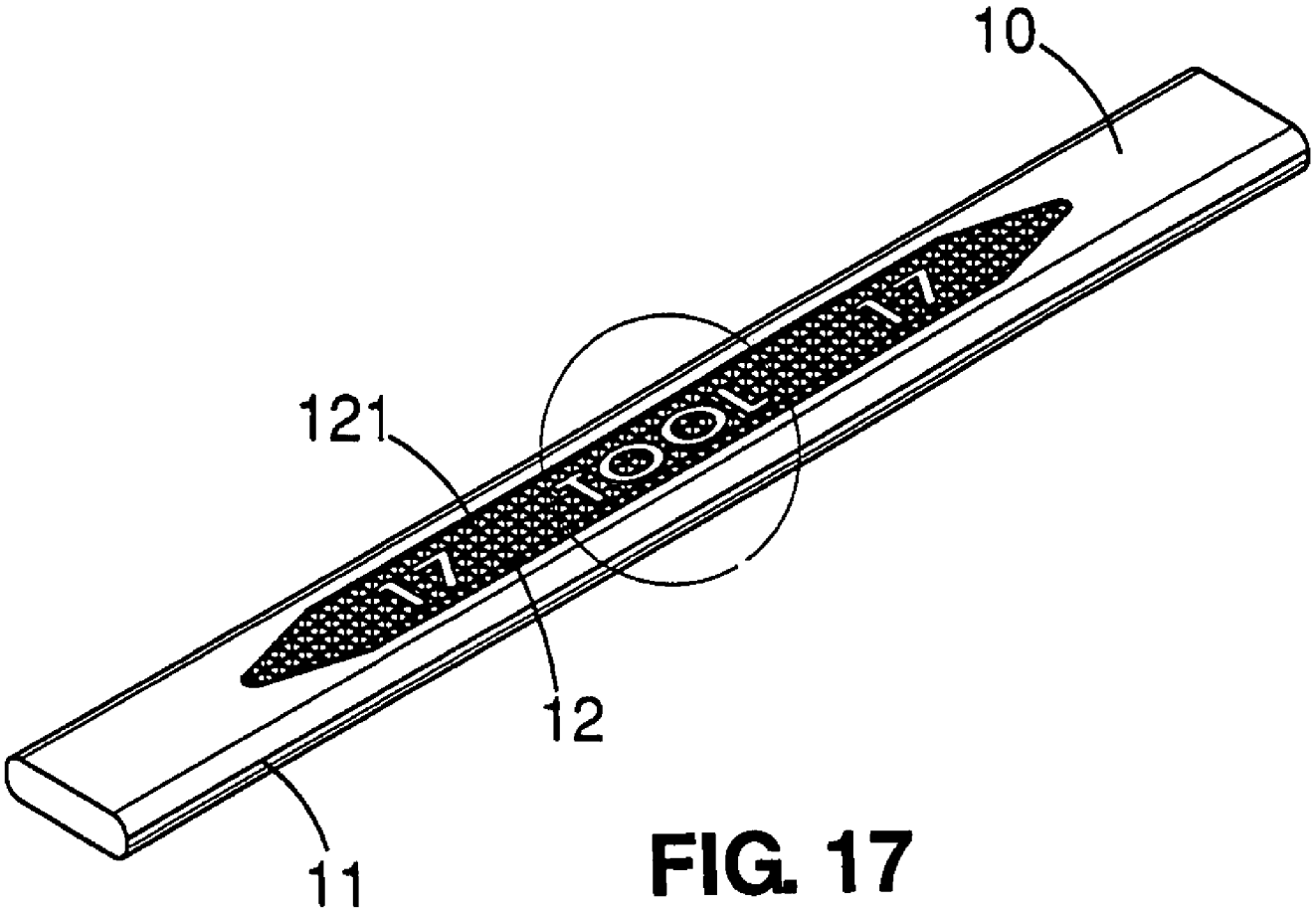
FIG. 17 is a 3-dimensional diagram to show the grip of the wrench of the invention.
Figure 18:
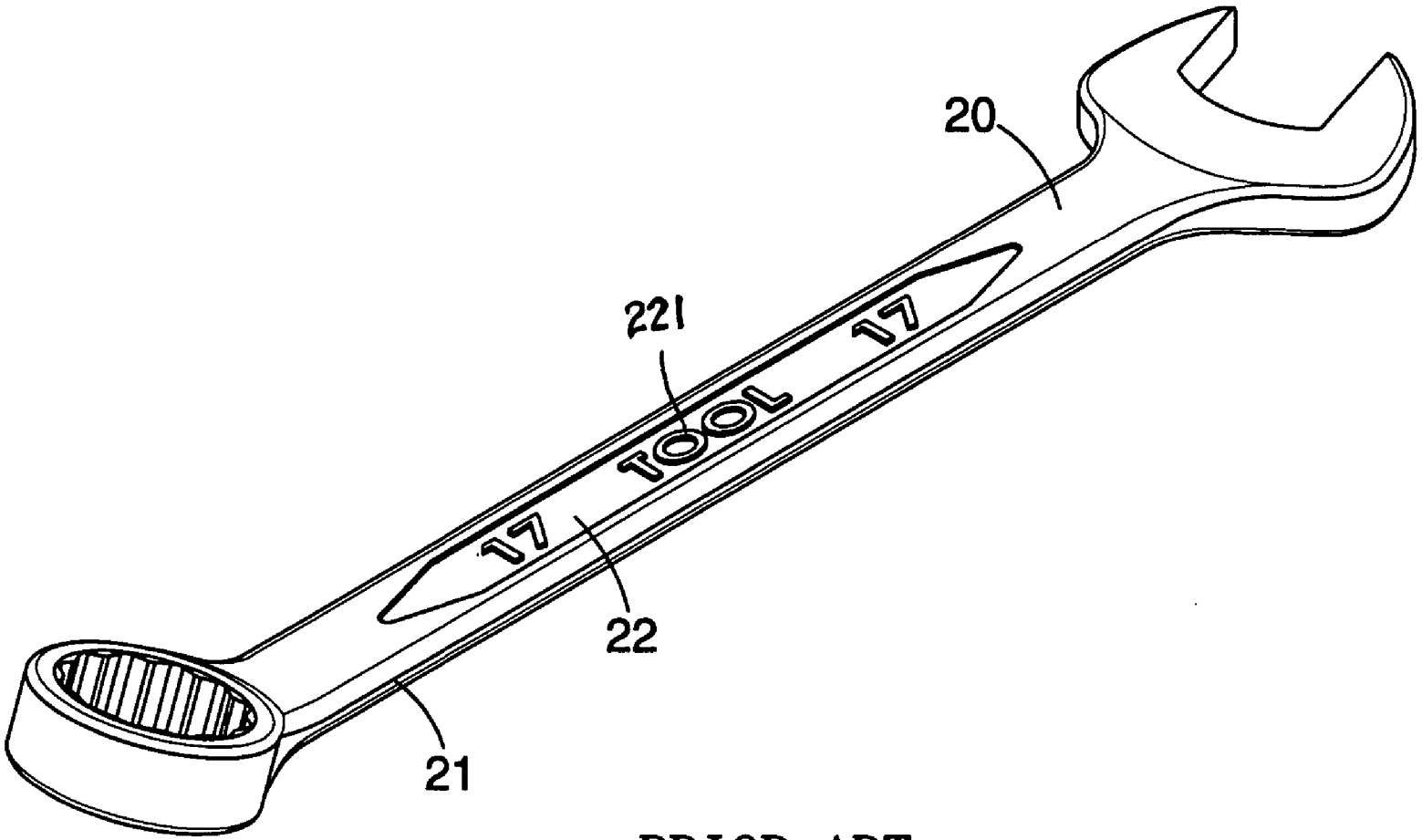
PRIOR ART FIG. 18
FIG. 18 is a 3-dimensional diagram of the conventional wrench.

Referring to FIG. 17, the present invention is emphasizing the grip 11 of the wrench 10, types of driving heads adopted at the two ends of the grip 11 are not specified, i.e. the driving heads can be open type, box type or with ratchet wheels.

In summary of the present invention, the surface treatment applied to the whole set of the wrench made the wrench has either reflexible surface or non-reflexible surface, the sunken area 12 is full of intensive plurality of knurls 121 which surround the embossed mark 122, therefore the embossed mark 122 is outstanding and visual identification. Through design the mark area can have various graphs to increase the visual beauty meanwhile the purpose of comfort and firmness in grip is achieved.

What is claimed is:

1. A wrench comprising:

a grip with two ends and a longitudinal axis which extends to the two ends;

at least one end is a driving head; and at least one mark area is on the surface of the grip, the mark area includes a sunken area wherein intensive plurality of knurls is implemented therein and at least one embossed mark is established therein, wherein the plurality of knurls is formed by press forming, the cross section of the sunken area is a concaved curve, and the embossed mark being surrounded and adjacent with the intensive plurality of knurls is visually outstanding.

2. The wrench as described in claim 1, wherein the grip has two wide surfaces, and the mark area extends onto at least one wide surface.

3. The wrench as described in claim 1, wherein the grip has two wide surfaces, and the mark area extends onto both wide surfaces.

* * * * *